United States Patent [19]

Van Steenburgh, Jr.

[11] Patent Number: 5,050,401

[45] Date of Patent: Sep. 24, 1991

[54] COMPACT REFRIGERANT RECLAIM APPARATUS

[76] Inventor: Leon R. Van Steenburgh, Jr., 850 East La., Estes Park, Colo. 80515

[21] Appl. No.: 468,229

[22] Filed: Jan. 22, 1990

Related U.S. Application Data

[63] Continuation-in-part of Ser. No. 380,691, Jul. 13, 1989, Pat. No. 4,967,570, which is a continuation of Ser. No. 109,958, Oct. 19, 1987, abandoned.

[51] Int. Cl.[5] ..... F25B 45/00

[52] U.S. Cl. ..... 62/292; 62/470

[58] Field of Search ..... 62/149, 292, 77, 85, 62/195, 468, 470, 472, 474, 475

[56] References Cited

U.S. PATENT DOCUMENTS 4,768,347 9/1988 Manz et al. ..... 62/149

4,939,903 7/1990 Goddard ..... 62/149

*Primary Examiner*—Henry A. Bennet

*Attorney, Agent, or Firm*—Beaton & Swanson

[57] ABSTRACT

A compact refrigerant reclaim apparatus that is capable of removing refrigerant from a refrigeration system during repairs in order to remove oil and other impurities from said refrigerant and being capable of returning the refrigerant to the refrigeration system in a clean state. The apparatus includes an oil separator that includes oil separation and oil accumulator means.

5 Claims, 4 Drawing Sheets

COMPACT REFRIGERANT RECLAIM APPARATUS

CROSS-REFERENCE TO RELATED APPLICATIONS

This is a continuation-in-part of copending application Ser. No. 07/380,691 filed July 13, 1989 now U.S. Pat. No. 4967570, which is in turn a continuation of application Ser. No. 07/109,958 filed Oct. 19, 1987, for "Refrigerant Reclaim Method and Apparatus" now abandoned, and related to copending application Ser. No. 07/309,421 filed Feb. 10, 1989, a continuation-in-part of the application Ser. No. 07/109,958 now abandoned.

FIELD OF INVENTION

This invention relates to an apparatus for removing refrigerant from a refrigeration system during repairs or simply to purify the contaminated refrigerant, confining it so as to avoid its escape to the atmosphere, separating contaminants from the refrigerant and returning the refrigerant to the refrigeration system or discharging it to a storage container.

BACKGROUND OF THE INVENTION

In the past, little attention was paid to the storage or recycling of refrigerant. When refrigeration systems were being repaired or when the refrigerant, such as those sold under the trademark "Freon", was contaminated sufficiently to affect the effectiveness of refrigeration, the refrigerant was vented into the atmosphere.

Recent developments have, however, created a demand for systems capable of storing refrigerant while at the same time purifying the contaminated refrigerant. Due to the enactment of recent federal and international regulations, it is impermissible to release even small amounts of almost any refrigerant into the atmosphere.

Systems that can retrieve refrigerant, purify and store the refrigerant, and return it to a useable state without any release into the environment will soon be needed by every business that has significant amounts of refrigeration equipment. The present invention relates to modifications and improvements on the refrigerant reclaim method and apparatus as described in co-pending U.S. patent application Ser. No. 07/380,691 of Van Steenburgh, Jr.

U.S. patent application Ser. No. 380,691, discloses an apparatus for drawing refrigerant from a container, or a refrigeration system to be repaired, heating the refrigerant sufficiently to maintain it in a gaseous state while it passes through an oil separator into the intake of a compressor. Compressed gaseous refrigerant is discharged from the compressor and passed through a heat exchanger to heat the incoming liquid refrigerant and then passes through to a condenser where its liquification is completed. Generally some condensation of the gaseous refrigerant will occur in the heat exchange means, and in some stages of operation the gaseous refrigerant will be completely liquified before introduction into the condenser. The condenser acts as a back up to the heat exchanger means to assure total liquification under all conditions.

The liquified refrigerant is passed from the condenser into a chill tank. Liquified refrigerant is removed from the bottom of the chill tank and passed through a filter-dryer and an expansion device to again vaporize the refrigerant. The gaseous refrigerant is then passed through a coil submerged in the liquid refrigerant in the chill tank. The temperature of the liquid refrigerant is lowered by the chilling effect of the expanding gaseous refrigerant passed in a thermally conductive path through the chill tank. The gaseous refrigerant is then introduced into the inlet of the compressor, where it is compressed and passed through the heat exchanger and the condenser and back to the chill tank.

The refrigerant can be repeatedly passed from the chill tank through the filter-dryer, expansion device, cooling coil, compressor, heat exchanger, condenser and back to the chill tank. This repeated process will progressively lower the temperature of refrigerant in the chill tank, increase the refrigerant purity by repeated passing through the filter-dryer, and, by lowering the temperature of the refrigerant, maximize the separation of air from the refrigerant.

One drawback of the device described in application Ser. No. 380,691 is the size and weight of the entire system. As described and with the preferred components, the completed system is also relatively expensive. A device that combines the operational performance characteristics of the device described in the application Ser. No. 380,691 yet has a lower price, is lighter and smaller would be a great improvement and would find a large market.

U.S. patent application Ser. No. 309,421 describes several improvements to the system described in the application Ser. No. 380,691. One of these improvements is the inclusion of an oil accumulator device in-line with the compressor of the basic refrigeration reclaim system. The oil accumulator serves several functions in the refrigerant reclaim system. One function, is to remove any residual oil in the incoming contaminated refrigerant that has gotten past the main oil separator.

The primary function of the oil accumulator, however, is the removal of oil from the refrigerant that originates from the compressor, and the return of this oil to the compressor. In a piston-type compressor, with every stroke of the piston a very small amount of oil—which of necessity must be present in the piston chamber—leaves the compressor with the compressed refrigerant. Over time and with repeated expansion/chilling cycles, the compressor will continually lose oil to the refrigerant. The oil accumulator acts to remove this residual oil from the refrigerant and return it to the compressor. The end result is a refrigerant containing a minimal amount of oil, and a greatly reduced oil loss from the compressor. The undetected loss of oil from compressors is one of the major causes of refrigerant reclaim system breakdowns.

SUMMARY OF THE INVENTION

The present invention provides a method and means for drawing refrigerant from a container, or a refrigeration system to be repaired. The system of the invention includes heat exchange means for assuring that all refrigerant entering the system be vaporized into a gaseous state or remains in the gaseous state. The gaseous refrigerant is passed through an oil separator chamber where substantially all of the oil contained in the contaminated refrigerant is removed from the refrigerant. The oil-free gaseous refrigerant is passed through a discrete oil accumulator device that is contained within the oil separator chamber. After exiting the oil accumulator device, the gaseous refrigerant is passed to the intake of a compressor. The compressed gaseous refrigerant is then passed in thermal conductive relation with the incoming refrigerant via the heat exchange means. It is by this mechanism that the incoming refrigerant is heated and vaporized prior to entering the oil separator chamber.

To the extent that the compressed gaseous refrigerant in not condensed in the heat exchange means, a condenser is employed to complete condensation of the refrigerant. Therefore, the refrigerant exiting the heat exchange means is passed through condenser means. The condenser means consists of a series of coils that are cooled by air flow generated by at least one fan. The liquified refrigerant is passed from the condenser into a chill tank from the bottom of which liquid refrigerant flows through a filter-dryer and an expansion device for reconverting the liquid refrigerant to gaseous form.

From the expansion device the gaseous refrigerant passes through a coil submerged in the liquid in the chill tank. The gaseous refrigerant is introduced into the system just before the oil accumulator that is held within the oil separator chamber. A one-way check valve upstream from the point of introduction is present in order to prevent flow of the gaseous refrigerant into the body of the oil separator chamber and to assure flow through the oil accumulator and to the intake of the compressor.

The temperature of the liquid in the chill tank is lowered by the chilling effect of the expanding gaseous refrigerant passing through the coil submerged in the liquid. The refrigerant can be repeatedly passed from the chill tank through the filter-dryer, expansion device, cooling coil, oil accumulator, compressor, heat exchanger, condenser and back to the chill tank so as to not only progressively lower the temperature of the refrigerant in the chill tank, but to also repeatedly, and thus more completely, remove acid and water from the refrigerant.

The presence of the oil accumulator device in the oil separator chamber has at least two benefits over existing systems. A critical factor is in the space efficiencies created by this arrangement. In addition, during the chilling operation of the system, the cooled gaseous refrigerant enters into the oil accumulator and acts to reduce the temperature within the oil separator before additional refrigerant reclaiming begins. The cooled oil separator increases the separation of oil and water from the incoming refrigerant, and decreases the likelihood of compressor shutdown during the next reclaim cycle.

The size and weight of the system of the present invention is reduced by the placement of the oil accumulator device within the oil separation chamber, and the use of the elongated air cooled condenser.

DESCRIPTION OF THE PREFERRED EMBODIMENTS

Figure 1:
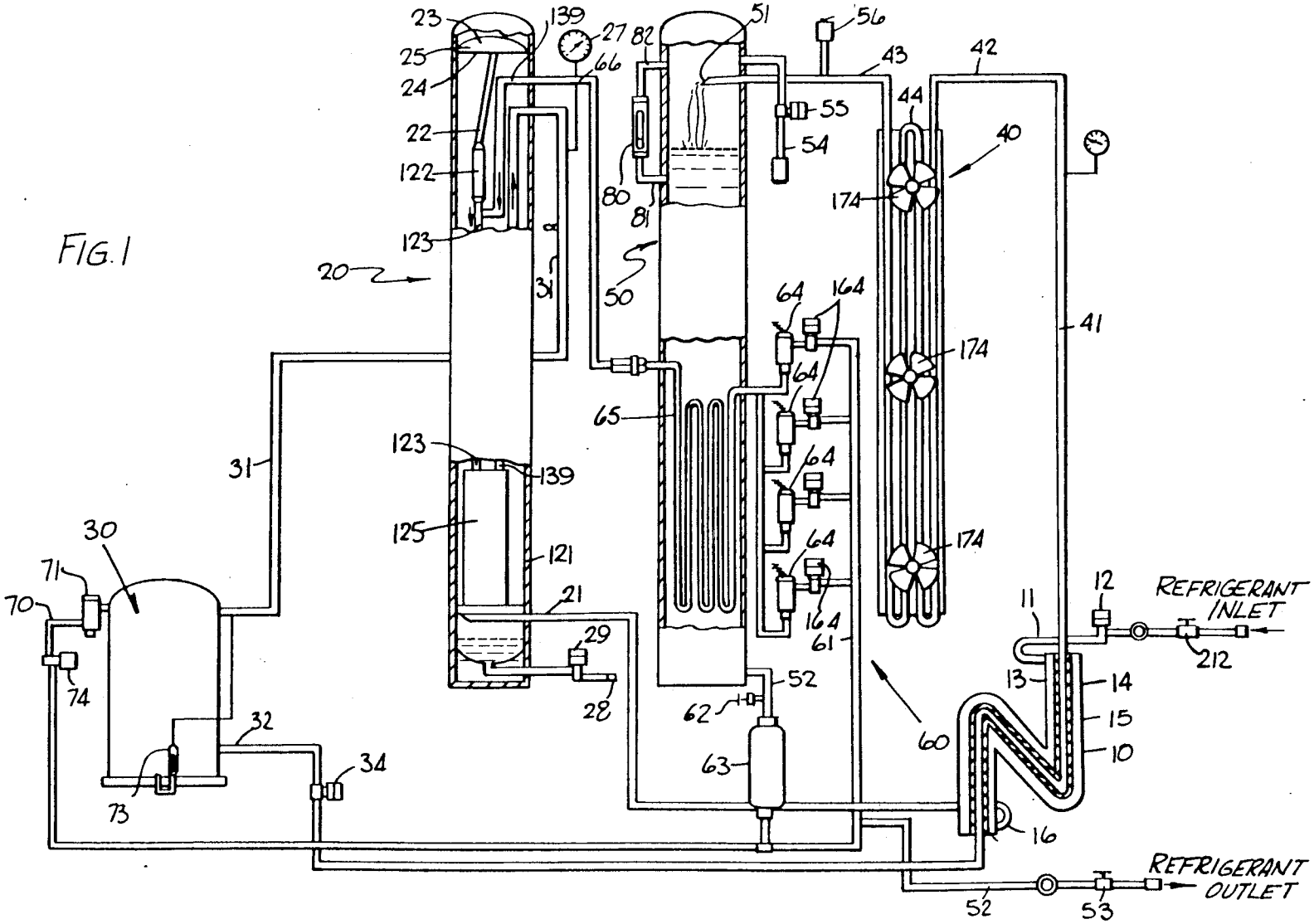
FIG. 1 is a schematic illustration of the invention in which the parts illustrated are either standard items which can be purchased or are disclosed in sufficient detail when viewed in conjunction with the description so as to teach those skilled in the art how to practice this invention.

As illustrated in FIG. 1, the reclaim system of this invention includes a heat exchanger 10, one portion of which is in fluid communication with a refrigerant intake fluid conduit 11 controlled by inlet valve 212. The conduit 11 is in fluid communication with conduit 13 which constitutes the cold side of heat exchanger 10. The conduit 13 is illustrated as being joined to conduit 15 by thermally conductive weld 14. Conduit 15 constitutes the hot side of heat exchanger 10. The heat exchanger arrangement shown in the drawing is for illustrative purposes only. In practice it is preferred that intake 11 be in fluid communication with a conduit with a spiral fin, or ridge and groove arrangement, facilitating its being mounted within a conduit to form a so-called tube-within-a-tube heat exchanger. Preferably also the tube-within-a-tube construction is in the form of a coil so as to provide greater length in a smaller space than would be possible with a straight tube-within-a-tube construction. The coiled tube-within-a-tube is a standard item well known in the heat exchange art, and it will be apparent that the inner tube is the hot side of the heat exchanger.

Conduit 16 constitutes the outlet from the cold side of the heat exchanger 10 and is in fluid communication with the oil separation chamber 20 through conduit 21. The oil separator 20 is preferably an elongated pressure cylinder with partially spherical ends mounted so that its longitudinal axis extends vertically. The fluid conduit 21 extends through the outer wall 121 of the oil separator chamber near the bottom of the tank and has a slight turn within the chamber. In this manner, gaseous refrigerant exiting the conduit 21 will circulate along the interior walls of the tank.

Another fluid conduit 22 has its open end fixed near the inner surface of the rounded top of the tank. This fluid conduit extends downwardly and supports a circular baffle 23 composed of a disc like portion 24 and a downwardly extending partially cone-shaped skirt 25. Conduit 22 is in fluid communication with check valve 122 below said circular baffle. The check valve 122 prevents the flow of refrigerant upwardly through conduit 22.

Conduit 123 is in fluid communication with check valve 122. An additional conduit 66 that exits near the top of oil separator chamber 20 is in fluid communication with conduit 123. Conduit 123 extends downwardly to the intake of the oil accumulator 125. The oil accumulator 125, shown in more detail in FIG. 2, is contained within the oil separator chamber 20 in the bottom portion of the chamber.

Figure 2:
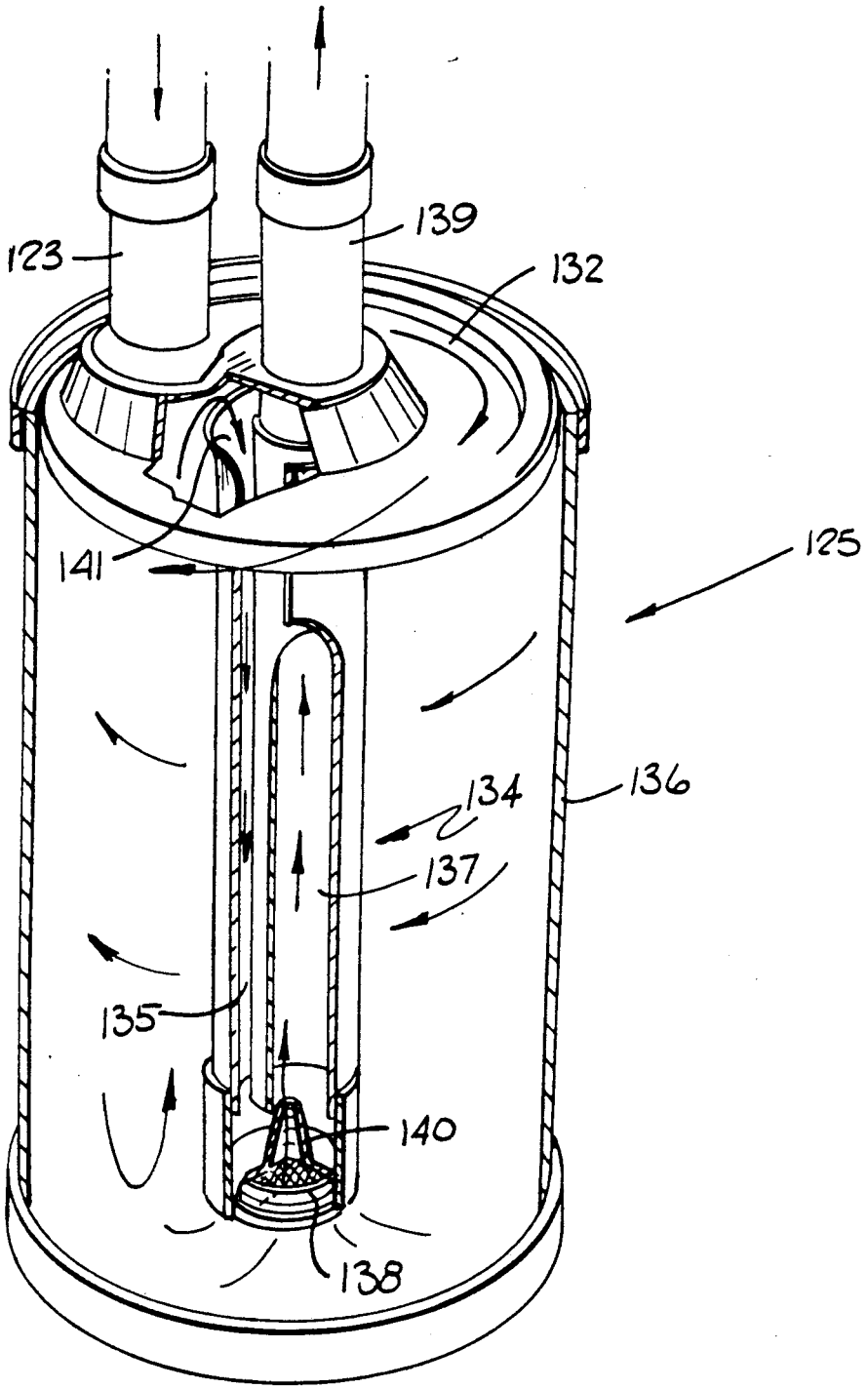
FIG. 2 is a cross-sectional view of the oil accumulator of the present invention.

Oil accumulator 125, shown in FIG. 2, is made up of a cylindrical canister 136, a directional gutter 132, a bifurcated tube 134, a liquid collection reservoir 138 and a metering orifice 140. Fluid conduit 123 extends through the top of the outer wall of oil accumulator 125. The interior of the oil accumulator 125 is in fluid communication with fluid conduit 139 via the bifurcated tube 134.

The bifurcated tube 134 is made up on an outer chamber 135 and an inner chamber 137 in fluid communication with each other. The outer chamber has an opening 141 into the interior of the canister 136. The bifurcated tube 134 is in fluid communication with the collection reservoir 138 at the bottom of the canister 136 through a metering orifice 140 located at the bottom of the bifurcated tube 134.

Fluid conduit 139 extends upwardly within the oil separator chamber 20 and exits the chamber near the top. Conduit 139 is connected to fluid conduit 31 controlled by a low pressure activated electrical control device 27 having a pressure gauge indicator associated with it. The control 27 will automatically shut down compressor 30 when the pressure in conduit 31 drops to virtually zero PSIG.

Fluid conduit 31 extends through the outer wall of compressor 30 and a short distance into its interior. Fluid conduit 70 also extends through the outer wall of compressor 30 and a short distance into its interior. Conduits 31 and 70 are designed to release refrigerant onto the electrical coils found within the compressor 30. Flow through conduit 70 into the compressor 30 is controlled by a low pressure activated electrical control device 71 and solenoid valve 74. The control device 71 is located so that it will permit flow into the compressor 30 when solenoid valve 74 has been opened and the pressure within the compressor 30 drops to a preset level.

Compressor 30 is provided with an oil sight gauge 73. Outlet conduit 32 has a high pressure activated electrical control device 34 associated with it and is in fluid communication with fluid conduit 15. Conduit 15 of heat exchanger 10 is in fluid communication with conduit 41, which in turn is in fluid communication with a condenser 40 through condenser inlet conduit 42. If pressure in conduit 32 is too high, control 34 acts automatically to shut down compressor 30 and opens value 55.

The condenser 40 of the preferred embodiment is made up of a series of conduit passes that will be air coiled by a plurality of fans 174. In the most preferred embodiment of the invention, the condenser is constructed as a relatively tall and thin rectangle that has three fan assemblies 174 one above each other on one side of the condenser 40.

Outlet conduit 43 connects condenser 40 in fluid communication with chill tank 50, which as illustrated is an elongated, cylindrical pressure tank arranged with its longitudinal axis extending vertically with its upper and lower ends of partially spherical shape. Outlet end 51 of fluid conduit 43 is located substantially on the axis of chill tank 50. At the bottom of the chill tank 50 there is a third conduit 52 controlled by valve 53 and arranged in fluid communication with the interior of chill tank 50. At the upper end of chill tank 50 there is an air outlet conduit 54 controlled by solenoid valve 55 having a pressure gauge indicator associated with it. Also located at the upper end of chill tank 50 is a high pressure activated safety valve 56.

Chill tank 50 is also provided with a float control 80. The float control 80 is in fluid communication with chill tank 50 via conduits 81 and 82. Conduit 82 is attached to the top of the float control 80 and enters the chill tank 50 at a point located somewhat below the upper end of the tank. Conduit 81 is attached to the bottom of float control 80 and enters the chill tank 50 at a point located approximately near the point midway between the upper and lower ends of the tank.

The float control 80 is located at a point outside of and next to the chill tank 50 at approximately the maximum level to which the chill tank may safely be filled with liquid refrigerant. As the level of liquid refrigerant in the chill tank 50 raises to a point above the place where conduit 81 enters the tank, the level of refrigerant within conduit 81 will be at substantially the same height as the level in the chill tank. When the level of liquid refrigerant in the chill tank 50 is at approximately the same height that the float control 80 is at, the float control will be activated and the level of refrigerant in the tank falls below the height of the flow control, the inlet solenoid valve 12 shut-off will be deactivated.

Located partially within and partially outside chill tank 50 is a cooling and recycling system 60 composed of a conduit 61 in fluid communication with conduit 52 and controlled by hand valve 62. The fluid conduit 61 is in fluid concentration with filter-dryer 63, which in turn is connected in fluid communication with a plurality of expansion means 64. In the preferred embodiment four expansion means 64 are provided. Each expansion means 64 is controlled by a solenoid valve 164. Fluid conduit 61 is also in fluid communication with inlet conduit 70 of compressor 30. Expansion means 64 are in fluid communication with conduit 65 arranged in the form of a coil within the chill tank 50. The cooling coil 65 is in fluid communication with conduits 66 and 123. The refrigerant outlet for the system is via fluid conduit 52 and is controlled by outlet valve 53.

All the elements of the reclaim system of this invention can be mounted as a mobile unit, discussed in more detail below, having a control panel.

The control panel includes a power on-off switch which, depending on the positions of various valves and the pressures at various points in the system, energizes the compressor 30 and the valves 29 and 55. Since controls 27 and 34 shut down or start up compressor 30 automatically when the power is on, and since relief valve 56 responds automatically to pressure, the control panel need not include switches for manually activating these devices.

The control panel includes a "vapor" on-off switch which activates the solenoid valve 74. When the vapor switch is turned on solenoid valve 74 is opened, and the low pressure activated control 71 is capable of allowing controlled amounts of liquid refrigerant to enter into the compressor 30 via intake conduit 70 when the pressure in compressor 30 drops below a predetermined level.

The control panel also has a "compressor on" switch which overrides all automatic compressor switch offs and directly supplies power to the compressor 30. The "compressor on" switch is pressure activated and cannot be kept in the "on" position without being continually held on by the operator.

The control panel also has a refrigerant selection control which is set to indicate which type of refrigerant is to be reclaimed. The refrigerant selection control opens one solenoid valve 164 so that refrigerant flows through its associated expansion device 64. Each expansion device 64 is intended for use with a different type of refrigerant. The refrigerant selection control ensures that the expansion device 64 is used which is appropriate for the particular refrigerant reclaimed.

In addition to these controls, the control panel needs only the following additional controls (1) a packless hand valve 212 for allowing the introduction of refrigerant into the system via conduit 11, (2) a switch for valve 29 (oil out), (3) a packless hand valve 53 for allowing refrigerant to exit the system via conduit 52 (refrigerant out), (4) a switch for valve 55 (air out), and (5) a packless hand valve 62 (control for cooling and recycling system 60). The control panel also includes two pressure gauge indicators, one for displaying the pressure entering conduit 31 and the other for displaying the pressure at control device 34 and the upper portion of chill tank 50. Details of the circuitry for electrically connecting switches, controls, valves and gauges will be apparent to those skilled in this art.

Figure 3:
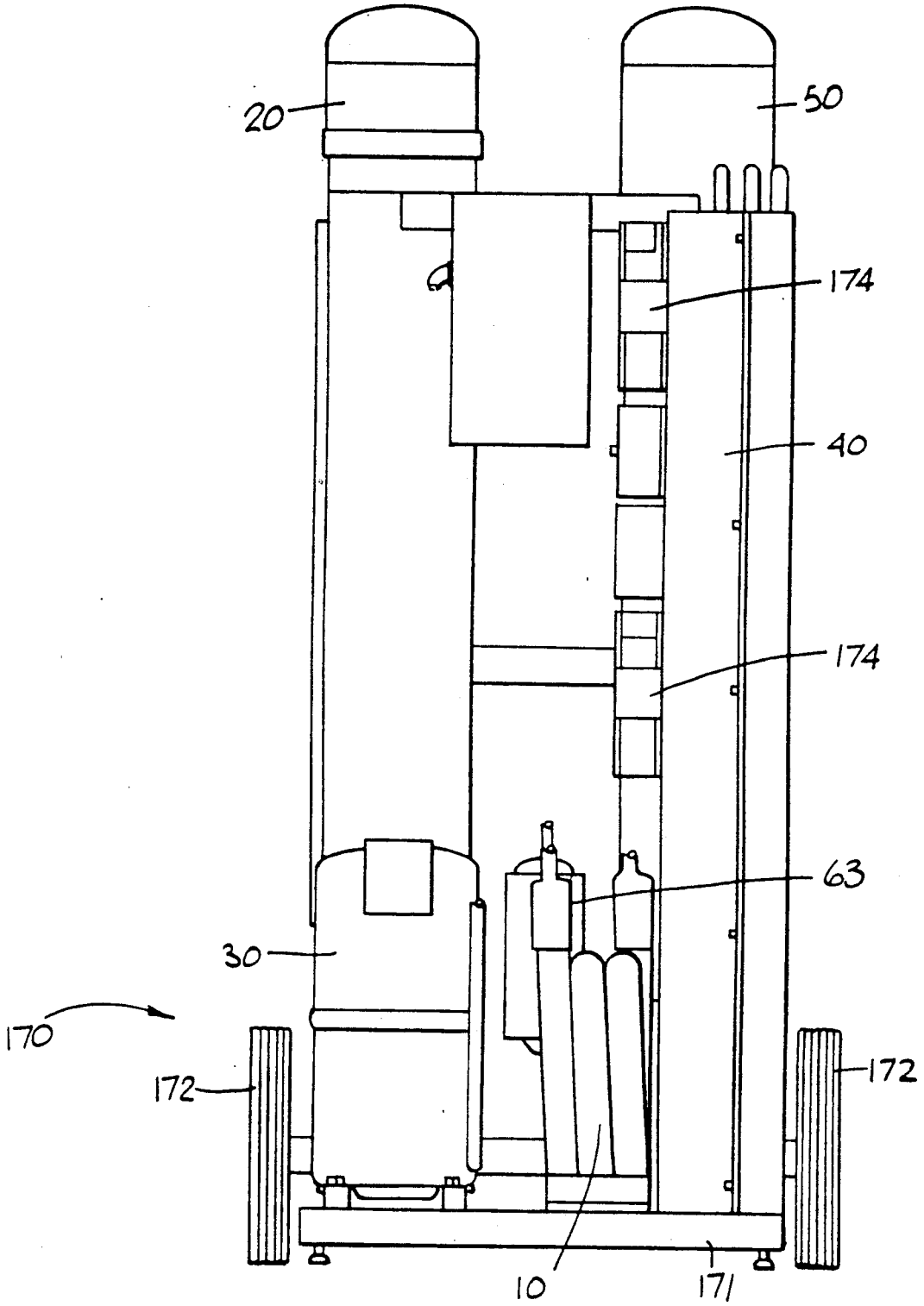
FIG. 3 is a front elevational view of an embodiment of the present invention without a cabinet.
Figure 4:
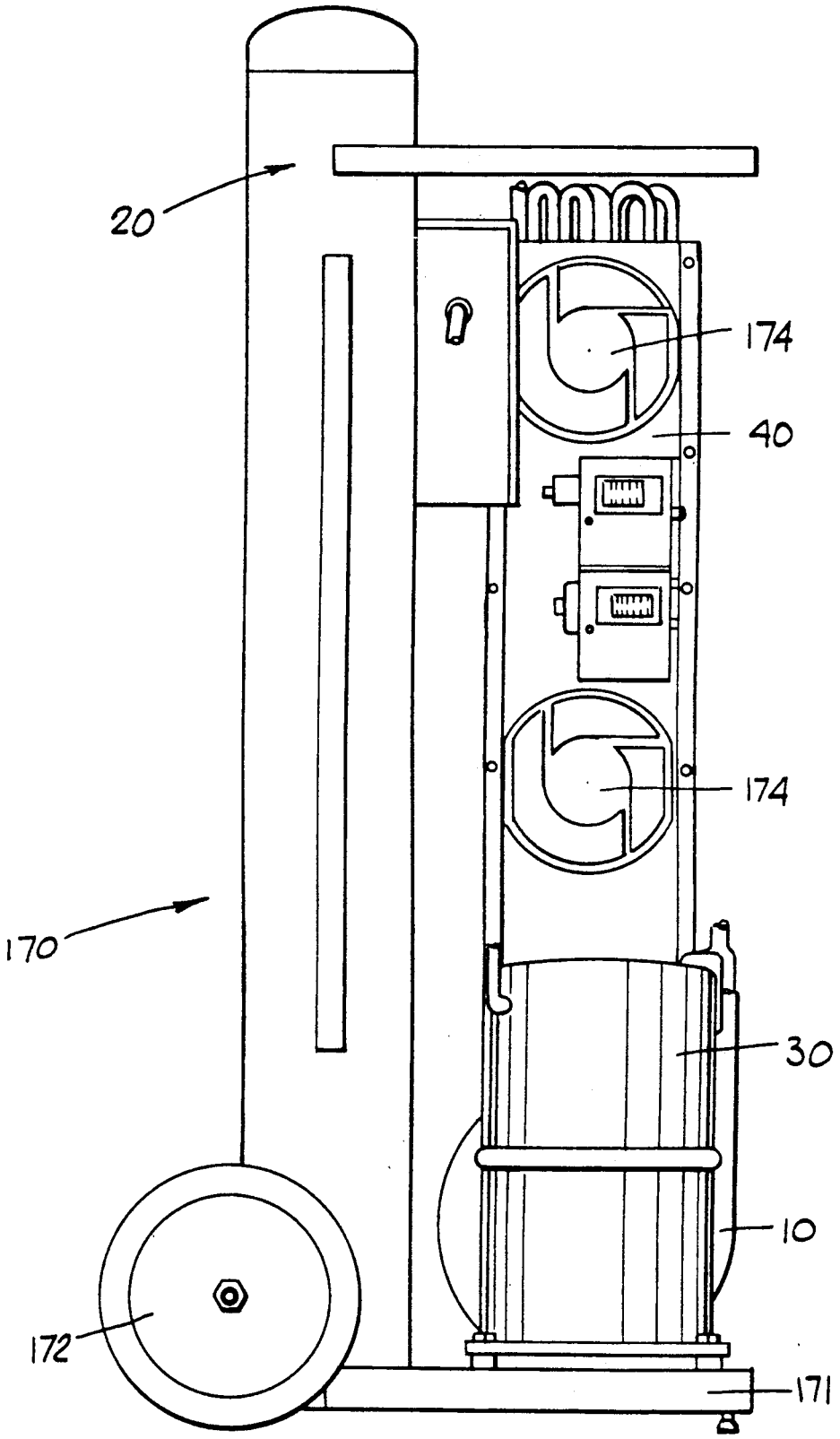
FIG. 4 is a side elevational view of the system show in FIG. 3.

In a preferred embodiment of the invention, shown in FIGS. 3 and 4, the refrigerant reclaim system of the present invention is contained on a two wheeled support 170. According to this embodiment, the entire unit is easily moved by a single person and is not so cumbersome as to be impractical for mobile use. The FIGS. shown do not include the front panel, cabinet or conduit connections between the various elements of the system, but rather show the configuration of the major elements of the apparatus in relation to each other.

In FIG. 3 the chill tank 50, and the oil separator chamber 20 rest side by side on the portion of the platform 171 of the support 170 nearest the wheels 172. The compressor 30 sits on the platform 171 in front of the oil separator chamber 20. The rectangular condenser 40 is designed to fit in front of the chill tank 50. The fans 174, that pass cool air through the condenser 40, are held one above each other on the side of the condenser 40. The heat exchange unit 10 rests on the front portion of the platform 171 between the compressor 30 and the condenser 40. The refrigerant filter 63 is positioned behind the heat exchanger 10. FIG. 4 shows the same embodiment from the side. In practice, the elements of the invention would be enclosed in a cabinet (not shown) that includes the control panel.

In the preferred embodiment, as shown in FIGS. 3 and 4, the chill tank 50 and the oil separator chamber 20 are about 48 inches in height and 6 inches in diameter and, as the largest elements in the system, define the dimensions of the entire apparatus. The chill tank 50 has a capacity to store or hold about 45 pounds of refrigerant such as R-12, R-22, R-502 or R-500 and meets ASME and Underwriters Laboratory Specification for pressure tanks.

The following is a compilation of the items which are standard devices which can be purchased, together with an identification of these items:

| Item Description | Manufacturer | Identification No. |
|---|---|---|
| Compressor 30 | Copeland Corp. | SSC4-0200 |
| Condenser 40 | Snow Coil Co. | 5858M786 |
| Heat Exchanger 10 | Packless Industries | AESOO1672 |
| Control 34 | Ranco, Inc. | 016-42 |
| Control 27 | Penn Corp. | P70AB-2 |
| Solenoid Valves 55, 29, 74 | Sporelan Valve Co. | E35-130 |
| Safety Valve 56 | Superior | 3014-400 |
| Gauges on control panel | Ashcroft | Laboratory quality 1377-A5 |
| Filter-Drier 63 | Sporelan Valve Co. | 384 cubic in. |
| Float control 80 | Watsco, Inc. | RLM-1 |
| Expansion Device 64 | Sporelan Valve Co. | |
| Oil Accumulator 130 | Tecumseh Prod. Co. | TK |
| Hand Valve 212,53,62 | Superior | 214-6S |

A unit constructed as disclosed above weighs about 220 pounds.

When the system illustrated is utilized in repair of the refrigerating systems of an air conditioner, for example, fluid conduit 11 is connected to a refrigerant outlet in the refrigeration system, the power is turned on and inlet valve 212 is opened, FIG. 1.

Control 27 at the inlet to the compressor is activated when it senses pressure in fluid conduit 31, and with the power turned on, compressor 30 begins to function. Refrigerant from the refrigeration system is drawn to the reclaim system through conduit 11. Normally the refrigerant at this point will be liquid, which has been illustrated in FIG. 1 by double cross-hatching inside the fluid conduit. When withdrawing liquid from the refrigeration system, the "vapor" switch should be in the off position At some point in fluid conduit 13 of heat exchanger 10 the refrigerant is converted to the gaseous state by the heat transferred to it from conduit 15 carrying the output of compressor 30. The refrigerant flows through fluid conduits 16 and 21 into oil separator 20. The refrigerant is relatively hot at this point and is an expanding gas rising rapidly within the tank of the oil separator 20. The upward flow of gas is abruptly interrupted by the baffle 23 causing oil to be separated and to drop to the bottom of the tank. The gaseous refrigerant passes around the outer (lower) edge of skirt 25 which is spaced from the interior wall of the surrounding tank by an amount providing a total open area which is approximately equal to the open area at the upper end of conduit 22. The gaseous refrigerant passes around skirt 25 into the upper end of fluid conduit 22, then through one way valve 122 into conduit 123.

Refrigerant in fluid conduit 123 enters the oil accumulator 125. The hot refrigerant vapor is forced to circulate around the interior of the accumulator canister 136 by the directional gutter 132. The rotational motion of the refrigerant causes substantially all of the oil droplets and mist and any liquid refrigerant to adhere to the interior walls of the canister 136. The liquid oil and refrigerant flows to the bottom of the canister 136 and collects in the liquid collection reservoir 138. The gaseous refrigerant enters the outer chamber 135 of the bifurcated tube 134 via the opening 141 and flows downwardly past the liquid collection reservoir 138 and into the inner chamber 137 of the bifurcated tube 134. The gaseous refrigerant then rises and exits the oil accumulator via fluid conduit 139.

The vast majority of oil entering the reclaim system with the refrigerant to be reclaimed is removed in the oil separator 20. The major source of oil in the refrigerant that has already passed through the oil separator is from the compressor motor. When in the chill mode refrigerant is continuously expanded, compressed and condensed. During this process oil is continuously leaving the compressor as a fine mist in the refrigerant. When passed through the compressor the oil mist in the refrigerant is compressed along with the refrigerant and does not replenish the oil in the compressor crankcase.

The oil accumulator 125 provides means for condensing and concentrating the oil mist in the refrigerant. When a certain equilibrium amount of oil has accumulated in the liquid collection reservoir 138, the gaseous refrigerant carries with it a measured stream of oil through metering orifice 140 into the compressor 30 via conduit 139. The stream of oil, unlike a mist, will not simply be compressed and be passed out of the compressor along with the refrigerant, but will migrate to the motor crankcase and restore lost oil to the compressor 30.

The oil accumulator 125 also acts as a safeguard against the possibility of liquid refrigerant entering the compressor to cause "liquid slugging." Although the reclaim system is designed to prevent the possibility of liquid slugging an additional safeguard is valuable to protect the compressor from the destructive effects of liquid slugging.

Refrigerant from fluid conduit 139 passes through conduit 31 and into the compressor 30, is compressed and discharged through fluid conduit 32 and passes through the heat exchanger in fluid conduit 15 and then through fluid conduit 41 into condenser 40 through condenser inlet 42.

So long as there is sufficient pressure in the fluid conduit 31 to indicate that the refrigeration system of the air conditioner has not been completely evacuated, compressor 30 will continue to run. When all of the liquid refrigerant has been removed and only some gaseous refrigerant remains or only gaseous refrigerant is being reclaimed, the vapor switch should be in the "on" position. When the vapor switch has been turned on, solenoid valve 74 is opened and liquid refrigerant in conduit 70 may enter compressor 30 as allowed by low pressure activated control 71. The liquid injection cooling system, whereby controlled amounts of liquid refrigerant are directly released into the compressor 30 at inlet conduit 70 will only occur when the pressure in the compressor 70 indicates that there is not sufficient amounts of gaseous refrigerant in the system to assure adequate cooling of the compressor motor.

Depending on the mode of operation, the gaseous refrigerant may be fully condensed in the heat exchanger 10. As cool liquid refrigerant enters the system via conduit 11, the hot gaseous refrigerant exiting the compressor 30 via conduit 32 will be condensed at the same time that the incoming refrigerant is vaporized. The condenser 40 merely acts as an additional backup in this instance. However, in certain modes of operation, e.g., when only small amounts of gaseous refrigerant are being reclaimed, the gaseous refrigerant enters the condenser and is converted to a liquid at some point in the condenser such as 44.

Liquid refrigerant passes out of the condenser 40 into conduit 43 and through that conduit into the upper portion of chill tank 50. At this point, valves 53 and 164 are closed and the compressor will continue to withdraw refrigerant from the refrigeration system of the air conditioner, and to cause liquid refrigerant to be discharged into chill tank 50 until the pressure at the inlet to compressor 30 drops to virtually zero PSIG indicating all of the refrigerant has been removed from the refrigeration system of the air conditioner. At this point, control 27 will act to shut down compressor 30. When the vapor switch is on, the liquid injection of refrigerant will provide enough pressure in the compressor 30 to prevent control 27 from shutting down the compressor. When the source pressure and the system pressure are both the same, the vapor switch may be turned off and the system will quickly evacuate all traces of refrigerant and the compressor will shut off before any compressor overheating can occur.

In the situation where the refrigeration system being drained of refrigerant holds more refrigeration than the chill tank 50 can safely hold, the compressor 30 will be automatically shut down when the float control 80 indicates that the chill tank's capacity has been reached and the inlet valve 12 is shut.

After all of the refrigerant has been removed from the refrigeration system, the operator will close valve 212 (refrigerant intake) and open solenoid valve 164 causing liquid refrigeration to leave the chill tank 50 through fluid conduit 52, filter dryer 63, and fluid conduit 61. The liquid refrigerant then passes through the expansion means 64 where it is converted into a gas and passes through coil 65 to cool the liquid refrigerant, illustrated in the drawing as filling approximately ¾ of chill tank 50 and having the coil 65 submerged in it. If solenoid valve 74 and low pressure activated control 70 are open, a controlled amount of liquid refrigerant may be directed through conduit 70 into the compressor 30.

When valve 12 is closed, the cold side of the heat exchanger 10 and the entirety of oil separator 20 (aside from the oil accumulator 125) are shut down. With pressure in fluid conduit 31, the compressor continues to operate and the gaseous refrigerant passes through conduit 139 and is compressed and discharged from the compressor through fluid conduit 32 and thence through the heat exchanger 10 and condenser 40 back into the chill tank 50. The cycle just described is repeated continuously until the temperature of the liquid refrigerant in chill tank 50 has been reduced to the desired level, normally about 38 to 45 degrees Fahrenheit.

The repeated passing of liquid refrigerant through filter dryer 63 removes substantially all acid and water from the liquid refrigerant. During the recycling, normally a certain amount of air will also be separated from the refrigerant and accumulate in the upper portion of chill tank 50. Air may be removed from the reclaim system by opening valve 55 so that the air escapes through conduit 54. This is normally done when the pressure within the chill tank 50 reaches something in excess of 300 PSIG and is accomplished by activating a switch on the control panel. In the unlikely event that pressure in the chill tank 50 should reach a level of about 325 PSIG, safety valve 56 will be actuated and gases in the system will be vented. Preferably, there is an additional control for releasing gaseous contents of the chill tank 50 into the atmosphere should the pressure in the tank reach a level of about 400 PSIG. Such control may take the form of a pressure sensitive spring loaded ball bearing. Of course, the action of the float control 80 will generally prohibit filling of the chill tank 50 to a level that would require use of the back up safety devices for relieving excess pressure in the chill tank.

Before any liquid refrigerant is returned to the vessel from which it was removed, which is done by closing solenoid valve 164 and opening valve 53, any oil which has been collected in the bottom of oil separator 20, as schematically illustrated in the drawing, should be removed from the oil separator 20 through outlet 28 by opening valve 29. The amount of oil removed should be measured so that an appropriate amount of oil can be resupplied to the refrigeration system.

Liquid refrigerant is removed from the reclaim system via outlet conduit 52. A refrigerant system or a storage cylinder is attached to outlet conduit 52. Opening outlet valve 53 permits the cooled refrigerant to exit the reclaim system and flow into the refrigeration system or storage cylinder.

The refrigerant reclaim system of this invention may also be utilized to transfer refrigerant from one container to another. This is accomplished by connecting the fluid conduit 11 to the container from which refrigerant is to be taken (the first container) and fluid conduit 52 to the receiving or second container. Upon opening valve 12 and supplying power to compressor 30, refrigerant will be removed from the first container and passed through heat exchanger 10, the oil remover 20, the oil accumulator 125, the compressor 30, the condenser 40, and into chill tank 50. Operation is continued in this mode until the pressure display on the control panel indicates the first container has been evacuated.

As in the other operations, when all of the refrigerant has been removed from the first container, pressure in line 31 will drop to virtually zero PSIG, thus activating control 27 and shutting off the compressor which will not begin to run again until there is pressure in line 31 from the gaseous refrigerant exiting from the cooling device 60. When the final amounts of refrigerant in the first container is vapor, the vapor switch should be turned on, thus activating the liquid injection system by opening solenoid valve 74. When the first container is totally evacuated the vapor switch is turned off and valve 212 is then closed. Since it will facilitate discharging the refrigerant into the second container, it is desirable that valve 53 first be closed and solenoid valve 164 opened so that cooling device 60 will be operative. Operation in this mode is continued for a sufficient period to reduce the liquid refrigerant in chill tank 50 to the desired temperature. When the desired temperature is reached, solenoid valve 164 is closed, valve 53 is opened, and liquid refrigerant will flow from the chill tank 50 into the receiving container by gravity, and any pressure from gases in the upper portion of chill tank 50.

I claim:

1. An apparatus for reclaiming refrigerant comprising, in combination, means for removing gaseous or liquid refrigerant from a container, vaporizing means for vaporizing all of said liquid refrigerant, and oil separator chamber for separating oil from the gaseous refrigerant, a compressor for receiving and compressing said gaseous refrigerant from said oil separator chamber, oil accumulator means for receiving and removing oil mist from the gaseous refrigerant before it enters said compressor, and condenser means for receiving and condensing said gaseous refrigerant from said container, wherein said oil accumulator means is located within said oil separator chamber.

2. The apparatus of claim 1 wherein said oil accumulator means is comprised of a canister containing a directional gutter, a liquid collection reservoir, and a bifurcated tube, whereby said gaseous refrigerant from said container is caused to circulate within said canister by said directional gutter, oil mist accumulates in said liquid collection reservoir, and gaseous refrigerant exits said oil accumulator means via said bifurcated tube.

3. The apparatus of claim 1 wherein said oil accumulator returns oil removed from said gaseous refrigerant to the crankcase of said compressor.

4. The apparatus of claim 1 further comprising a heat exchanger comprised of said vaporizing means and said condenser means.

5. The apparatus of claim 1 further comprised of cooling means for removing liquid refrigerant from storage means, vaporizing said refrigerant, and introducing said vaporous refrigerant to said oil accumulator means.

* * * * *